United States Patent [19]

Lampard

[11] 4,134,276

[45] Jan. 16, 1979

[54] CONTAINER FOR STORAGE OF ARTICLES AND DEVICE FOR UTILIZATION OF SOLID CARBON DIOXIDE

[76] Inventor: Robert D. Lampard, 30 Kings Park Rd., West Perth, Western Australia, Australia

[21] Appl. No.: 798,520

[22] Filed: May 19, 1977

[51] Int. Cl.[2] ..... F25D 3/12

[52] U.S. Cl. ..... 62/383; 62/457; 62/465

[58] Field of Search ..... 62/383, 384, 457, 458, 62/464, 465, 466, 293; 165/96

[56] References Cited

U.S. PATENT DOCUMENTS

| | | | |
|---|---|---|---|
| 1,873,130 | 8/1932 | Jones et al. | 62/466 |
| 1,901,000 | 3/1933 | Robe | 62/383 |
| 2,032,130 | 2/1936 | Jurkat et al. | 62/457 |
| 2,515,750 | 7/1950 | Waller | 62/383 |
| 2,677,245 | 5/1954 | Edmondson | 62/383 |
| 2,713,779 | 7/1955 | Fitzgibbons | 62/384 |
| 2,780,074 | 2/1957 | Haanan | 62/383 |
| 2,838,916 | 6/1958 | Sola | 62/457 |
| 2,959,938 | 11/1960 | Giardini | 62/384 |
| 3,605,433 | 9/1971 | Strathaus | 62/384 |
| 3,896,658 | 7/1975 | Hahn | 62/383 |
| 3,971,231 | 7/1976 | Derry | 62/457 |

*Primary Examiner*—Ronald C. Capossela
*Attorney, Agent, or Firm*—Andrus, Sceales, Starke & Sawall

[57] ABSTRACT

A heat insulated container for cold storage of articles, the container having a device therewithin for containing solid $CO_2$. The device has a heat insulated body with an internal cavity open to a base thereof, the base resting on a lower heat conductive plate within the container such that the device can be positioned as desired in the container with a lower cavity opening facing the heat conductive plate. Solid $CO_2$ is positioned within the cavity, resting on a member mounted therewithin and movable in the cavity to vary the spacing of the solid $CO_2$ from the heat conductive plate, thus to vary the cooling effect of the solid $CO_2$.

21 Claims, 4 Drawing Figures

CONTAINER FOR STORAGE OF ARTICLES AND DEVICE FOR UTILIZATION OF SOLID CARBON DIOXIDE

BACKGROUND OF THE INVENTION

1. Field of the Invention

This invention relates to containers for the storage of articles at temperatures differing from ambient and to a device for utilization of solid carbon dioxide, which device is usable in conjunction with such containers.

2. Prior Art

For many years frozen $CO_2$ or "dry ice" has been extensively used in industry in a variety of manufacturing processes and also as a convenient cooling agent used in transport of frozen foods such as ice cream. In the form of dry ice, carbon dioxide provides a good refrigerant as its heat absorbtion upon subliming to gas at minus 109° F. is for every Kg (lb) in weight equivalent to 574 kj (247 BTU). This absorbtion rate is 71% greater than water ice which is only 336 Kj/Kg (144 BTU/lb), and when used, for example, to cool the interior of a portable insulated food or beverage container, the comparatively lesser volume occupied by the dry ice will permit a greater part of the container volume to be used for food or beverage storage. Also, as it sublimates from a solid directly into an inert harmless gas, there is no water damage or drainage problems as involved with water ice, and its very low temperature −109° F., makes practical the portable storage of frozen foods and ice cream for outdoor use.

In the past, whilst dry ice has been freely available to the general public direct from manufacturers, its use, while economically viable as compared with conventional water ice, has been plagued by a number of practical difficulties relating to its distribution and its use by the layman. In both areas its problems relate directly to the very low temperature at which dry ice changes state, so that in order to maintain it in solid form very sophisticated and expensive refrigeration plant is required. This makes automatic vending machines impractical; however, dry ice can be distributed if transported in bulk using very well insulated containers. Its slow sublimation losses can be commercially tolerated. A growing demand by the public for dry ice is foreseen and manufacturers have plans for widespread distribution. In commercial fields, solid $CO_2$ has been found to provide a convenient and economic refrigerant and various techniques and expertise have been developed to successfully utilize its properties. However, the average citizen, being inexperienced and unaware of its relative super cold nature, may treat it in the same manner as water ice, thus resulting in over cooling of food and drinks, burst glass containers and a comparatively short ice life. Being so cold it demands some respect in handling as it will burn the skin if left in contact for any length of time. If a child is imprudent enough to place a piece in the mouth, as is a common practice in hot weather with conventional ice, serious burns can result. These aspects, and the lack of promotion by the manufacturers, have retarded the general use of solid $CO_2$.

A most convenient way of producing dry ice is to form it into pellets, as these are easily handled and, unlike crushed water ice, have a dry nature and no tendency to conglomerate. However, such pellets present very large surface areas; while this aspect is desirable for rapid heat extraction for many applications, its rapid absorbtion rate gives a correspondingly shorter ice life. As the pellets start to sublime slowly at −109° F., even frozen food, at say −30° F., will still provide an effective heat sink, and the insulation properties of the container must be substantial to prevent loss to the external environment.

Cold storage containers are already known which can utilize solid $CO_2$. For example, U.S. Pat. Nos. 1,901,000 to Robe, 2,515,750 to Waller, 2,677,245 to Edmondson and 2,780,074 to Haanan are typical. U.S. Pat. No. 3,896,658 to Hahn also describes a device utilizing solid refrigerant to cool glass plates positioned on a projecting surface of the device. Generally, however, prior devices and containers are not specifically suited to everyday use, being too large and/or costly in structure for this purpose. An object of the invention is to provide a container which is relatively simple in structure and yet efficient in operation.

BRIEF SUMMARY OF THE INVENTION

According to one aspect of the invention there is provided a device for holding solid carbon dioxide for transfer of heat between the solid carbon dioxide and a heat transfer surface upon which the device is in use stood;

said device comprising a heat insulated body having an opening at one end and an interior cavity to which said opening provides communication said one end of said body defining a generally annular base surface around said opening for engaging said heat transfer surface when the device is stood thereon, said cavity extending away from said base surface and having therein a member which extends at least partly across the cavity to substantially close off a portion of the cavity between the member and an opposite end of said body remote from said one end, said member presenting an inwardly directed support surface for supporting solid carbon dioxide thereon within said closed off portion of the cavity, adjustment means being provided for moving said member to vary the spacing between the support surface of the member and said base surface whereby, when the device is in use stood on said heat transfer surface, the resistance to heat flow from the heat transfer surface to solid carbon dioxide supported on the support surface is variable by varying said spacing.

In another aspect the invention provides a heat insulated container for articles to be stored at a temperature different to ambient, said container having therein a device for storing solid carbon dioxide for cooling such articles, said device being supported on an internal surface of the container such that it is freely movable in the container and removable therefrom.

The invention also provides in a further aspect a heat insulated container for articles to be stored at a temperature different to ambient, said container having therein a device for storing solid carbon dioxide for cooling such articles, said device being supported on an internal surface of the container such that it is freely movable in the container and removable therefrom; said container comprising a base and an upstanding peripheral wall portion extending therefrom, said base and said upstanding wall portion being heat insulating, a base plate of high thermal conductivity being positioned within the container and over said base so that an upper heat transfer surface thereof defines said internal surface, said device comprising a heat insulated body having an opening at one end and an interior cavity to which said opening provides communication, said one end of said body defining a generally annular base surface around said opening engaging said heat transfer surface, said cavity extending away from said base surface and having therein a member which extends at least partly across the cavity to substantially close off a portion of the cavity between the member and an opposite end of said body remote from said one end, said member presenting an inwardly directed support surface for supporting solid carbon dioxide thereon within said closed off portion of the cavity, adjustment means being provided for moving said member to vary the spacing between the support surface of the member and said base surface whereby the resistance to heat flow from the heat transfer surface to solid carbon dioxide supported on the support surface is variable by varying said spacing.

In a still further aspect, the invention provides a heat insulated container for articles to be stored at a temperature different to ambient, said container having therein a device for storing solid carbon dioxide for cooling such articles, said device being supported on an internal surface of the container such that it is freely movable in the container and removable therefrom; said container comprising, structure defining a base and an upstanding peripheral wall portion extending therefrom to an access aperture to the container interior, together with a lid and securement means for securing said lid to said structure, said lid being conditionable in a first condition allowing access to the container interior via said aperture and to a second condition at which it is secured by said securement means to said structure so that the lid closes said aperture and presents to the container interior an inner surface which is substantially parallel to but spaced from said internal surface, said device being of height substantially equal to the spacing then existing between the inner and internal surfaces such that it is engaged at opposed ends by respective ones of these surfaces and clamped in position therebetween when the lid is in said second condition.

BRIEF DESCRIPTION OF THE SEVERAL VIEWS OF THE ACCOMPANYING DRAWING

The invention is further described with reference to the accompanying drawings in which.

DETAILED DESCRIPTION

Figure 1:
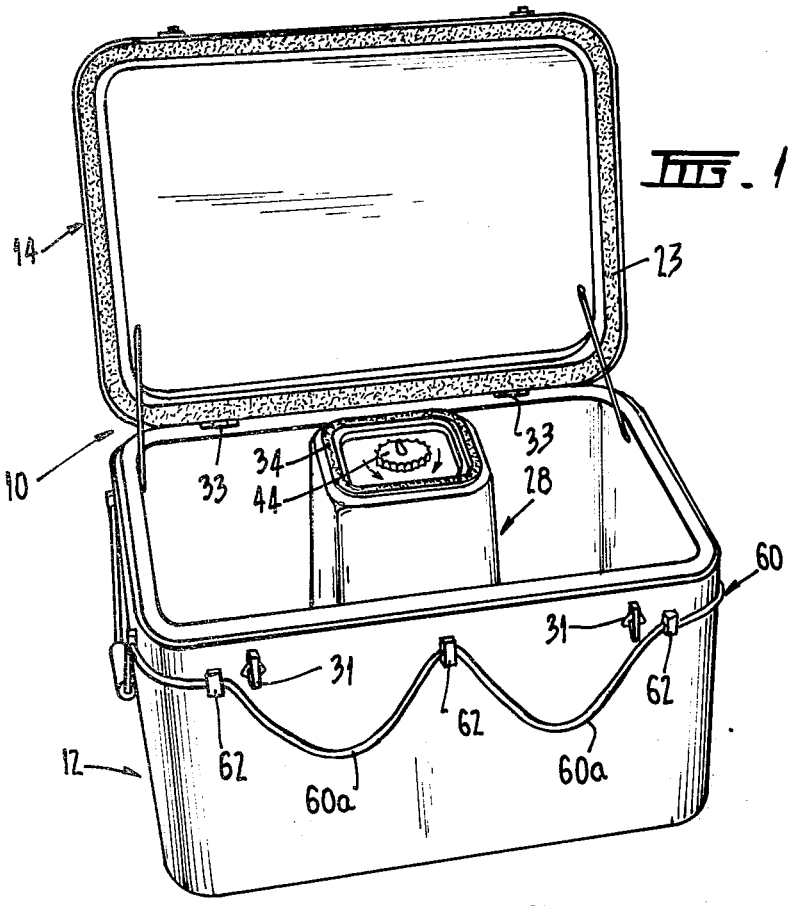
FIG. 1 is a perspective view of a cold storage container and dry ice container constructed in accordance with the invention.
Figure 3:
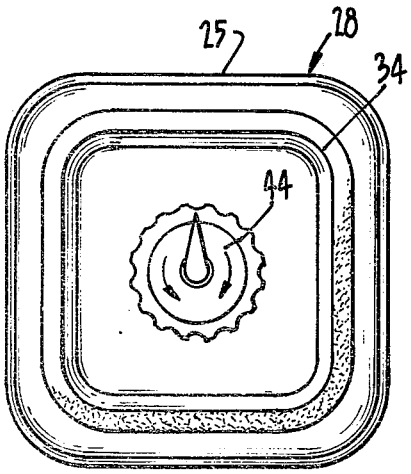
FIG. 3 is a cross-section on the line 3—3 in FIG. 2.

The container 10 shown in the drawings is in the form of an open-topped box structure 12 which can be closed by a lid 14 fitted thereover. Structure 12 includes a rectangular base 16 and an endless peripheral upstanding wall 18. The base and wall are conveniently formed of inner and outer layers of plastics material with a hollow interior therebetween which receives heat insulating material 20, such as polyurethane foam. Lid 14 is similarly formed of hollowed out plastics material filled with polyurethane foam 22. The upper rim of wall 18 have a suitable sealing strip 23 therealong so that when the lid is positioned on the structure 12, sealing is effected.

The upper surface of base 16 is provided with an array of upstanding "dimples" 24 and a metal plate 26 is supported on these in spaced disposition above base 16. Plate 26 is formed of material of good heat conductivity such as aluminum.

A device 28 formed in accordance with the invention is, in use, positioned on plate 26 as shown in FIG. 1. The device includes a body 25 having a side peripheral wall 30 of generally cylindrical form of square transverse section, closed at the upper end by an upper wall 32 so that a cavity 35 is formed within the body, this being open at the bottom and enclosed at sides and at the top by walls 30, 32. Wall 32 has a peripheral annular strip 34 of sealing material, such as rubber, positioned on the upper surface thereof and the height of the device 28 is made such that, when lid 14 is in position, the underside of the lid bears against strip 34 to hold the device 28 in position between plate 26 and the lid. To this end means may be provided to hold the lid in position on the structure 12, in a manner ensuring good retention of the lid and device 28 in position. In the container 10 shown, the lid is hinged to the structure 12 at one side by hinges 33, and cooperating elements 20, 31 of connector clips are provided on the lid and structure 12, at the other side thereof.

Walls 30, 32 are hollowed and filled with heat insulating material 37 such as polyurethane foam. The inner and outer surfaces of the two walls 30, 32 are preferably formed with a skin 36 of relatively dense plastics material to impart rigidity to the body 25.

Figure 2:
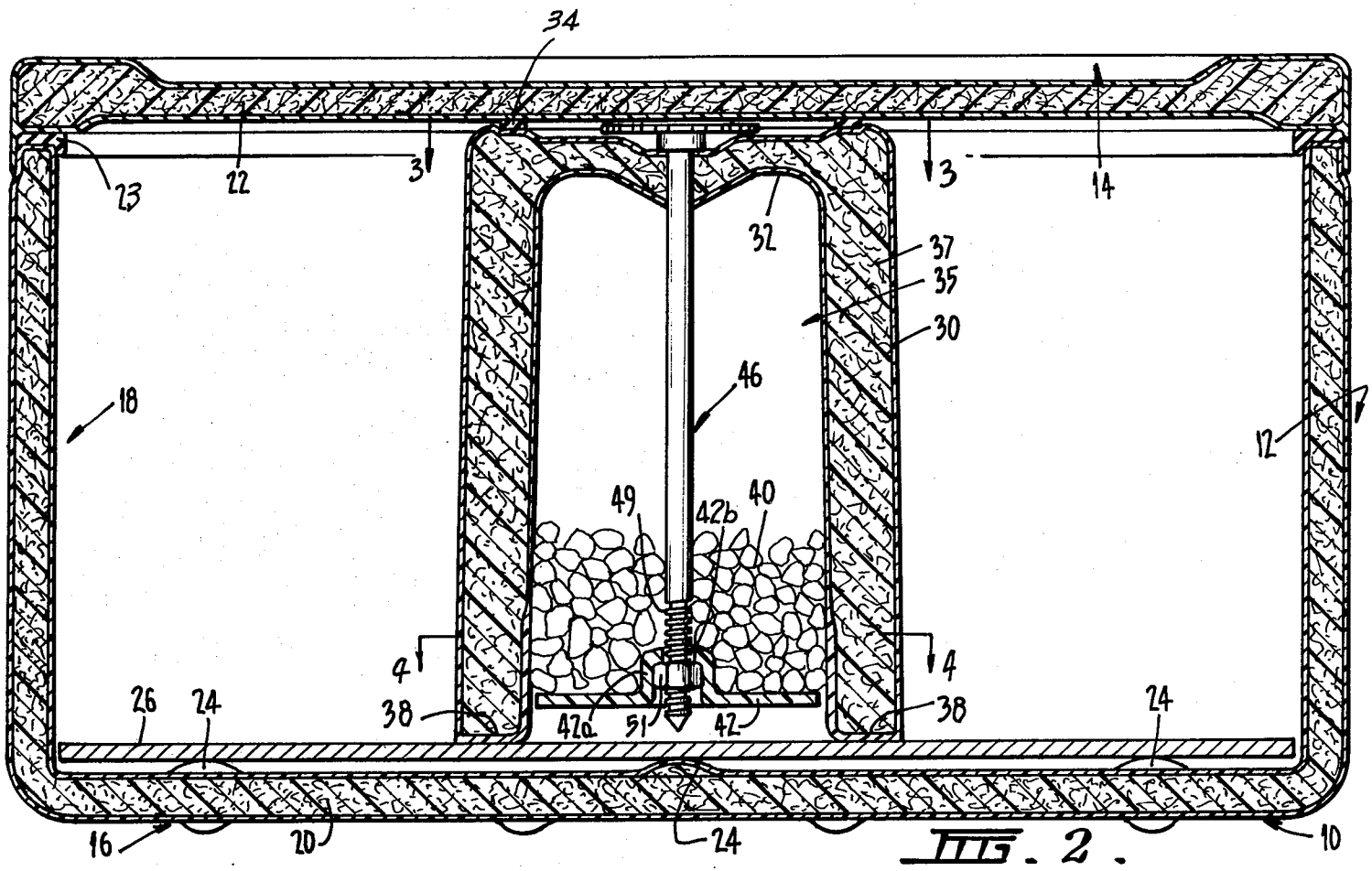
FIG. 2 is a transverse upright cross-section of the container and device of FIG. 1.

As will be appreciated from FIG. 2, when the device is stood on plate 26, only the lower peripheral rim 38 of the body 25 rests upon the plate 26. Solid $CO_2$ 40 is positioned within cavity 35. The solid $CO_2$ rests upon a lower support plate 42 within the cavity, the plate 42 extending generally parallel to plate 26.

A hand wheel 44 is positioned on the top of wall 32 and connected to a downwardly extending rod 46 which passes through wall 32 into cavity 25. The lower extremity of the rod 46 is positioned at the lower part of cavity 25 and is provided with a threaded end portion 49.

Figure 4:
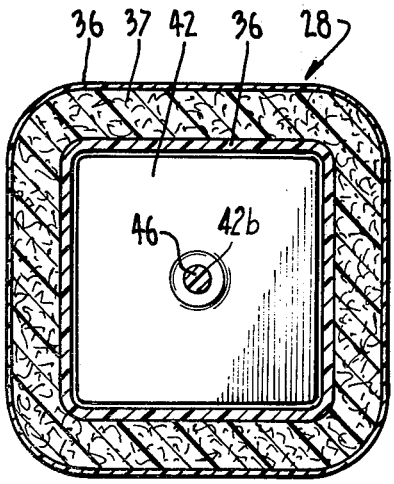
FIG. 4 is a cross-section on the line 4—4 in FIG. 2.

Plate 42 has an upwardly indented central portion **42*a* and a nut 51 is crimped therewithin so as to be secured to the plate. An aperture 42*b* is provided through the plate 42 at the center of portion 42*a* and the threaded end portion 49 of rod 46 extends through this to be threadedly engaged with nut 51. Rod 46 and hand wheel 44 are rotatable together so that when the hand wheel is rotated nut 51 is advanced along rod 46 to effect vertical movement of plate 42. Plate 42 is, as shown in FIG. 4, of generally square cross-section complementary to the internal cross-sectional configuration of body 25 so that rotation of the plate 42** is prevented during such movement.

In use, goods within container 10 are kept cool by heat flow to the solid $CO_2$ 40. This heat flow occurs along plate 26 and thence partly by conduction up the inner skin of wall 30 and partly by conduction, convection or radiation across the space between plates 26 and 42, although when the plate is in its fully down position it rests against plate 26 so that practically all of the heat flow occurs directly by conduction through the plate 42 to the solid $CO_2$ 40. By turning hand wheel 44 and raising plate 42 and the solid $CO_2$ 40 from the plate 26 the effective conductance of the heat flow path to the solid $CO_2$ is decreased. Thus, it is possible by appropriate rotation of hand wheel 44 to set the plate 42 at a location which will give regulation of the temperature of the contents of container 10 over a wide range.

In one embodiment of the invention plate 26 was of aluminium, measuring about 608 mm by about 408 mm and where the overall container dimensions were about 660 mm length, 470 mm width and 434 mm height, with approximately 38 mm of insulation at the bottom and about 30 mm in lid, the plate 26 being separated from the upper surface of the base 16 by about 6 mm, and the device 10 had about 36 mm insulation at the side walls thereof and with plate 42 about 150 mm square and formed of 6 mm thick PVC sheet. It was found that a temperature of approximately −100° F. could be attained at the plate 26 with the plates 42, 26 in contact. In this arrangement, a range of movement of the order of about 60 or 70 mm provided good control over the temperature plate, enabling temperatures of the order normally employed for food cooling purposes to be maintained in the container.

Preferably, the interfitting between the rod 46 and wall 32 is such as to prevent substantial escape of gaseous carbon dioxide therethrough so that the gaseous carbon dioxide must pass outwardly of the device through the gap between plate 42 and the inner surface of the wall 30 so that the, still cold, gaseous carbon dioxide produced by sublimation of the solid $CO_2$ is used to assist in the cooling action of the device 28. In this way, the effective absorbtion capacity of each pound of solid carbon dioxide is increased from the direct value of 247 BTU's to 274 BTU's. The arrangement is preferably such that the engagement between the wall 32 and the tube 46 is, in any event, fairly tight so as to ensure the maintenance of a particular setting of the hand wheel 44. Of course, the hand wheel could be suitably calibrated to give a general guide to the user as to a number of turns or parts thereof necessary to arrive at a given temperature condition in the container 10.

In the described arrangement, advantage is taken of heat conduction between plates 26, 42 both directly therebetween across any intervening air gap and between the solid $CO_2$ 40 and the plate 26 along the inner surface of the wall 30. However, it would be course be possible to utilize other heat flow paths. For example, if the plate 42 is made highly insulative the major heat flow path then is always along the inner surface of the wall 30, and this can be desirable in some instances. However, it has been found that the described arrangement is very satisfactory in use. Of course, whilst provision is made for moving plate 42, this is not essential and, even if movement is desired this movement could be achieved in ways other than described. For example, wedge or cam action devices could be utilized or, in a simple case, the plate 42 could simply be replaced by a plug which was frictionally or otherwise held in cavity 35, but nevertheless removable from the body 25. A set of such plugs could be provided each having different heights, for example, or otherwise arranged to give different heat transfer characteristics so that different temperatures could be obtained by using a selected one or more of the plugs.

The substantial separation between plate 26 and the upper surface of base 16 ensures relatively reduced direct heat transfer between these. The high conductivity of plate 26, with its large surface area ensures an even temperature distribution over the entire surface for efficient heat removal from the stored goods. Because the device ensures only a relatively slow rate of dissipation of the solid $CO_2$ 40, the heat transfer from the stored goods to the solid $CO_2$ is effected at a relatively high level of efficiency.

In order to fill the device 28, it is merely necessary to turn hand wheel 44 to disengage rod 46 from nut 51 thereby permitting the plate 42 to be removed. Then, solid $CO_2$, such as in the form of pellets, can be inserted into the device and the plate 42 replaced.

The described device and container have been designed particularly for use where transportability is desired, in particular for use as a food or beverage storage unit for domestic use and/or in boats, for example. The construction, utilizing as it does trapped insulation which is impervious to water absorbtion, renders it particularly suitable for marine use since it provides a dependable source of flotation in the event of emergency. As an aid to this, the structure 12 is fitted with a peripherally extending cord 60 secured to the outside of wall 18 by clips 62 so that a number of cord loops **60*a* are provided to facilitate holding of the container when it is floating. The container may also be formed of a bright colour to stand out against water as a further aid for rescue in such a case. The plastics construction for the container 10** minimizes corrosion difficulties such as occur with metal constructions. However, the container could, of course, be otherwise constructed, and the basic construction principle is suitable for large scale containers such as may be used on a truck mounted container.

The described construction has been advanced merely by way of explanation and many modifications may be made thereto without departing from the spirit and scope of the invention as defined in the appended claims.

I claim:

1. Device for holding solid carbon dioxide for transfer of heat between the solid carbon dioxide and a heat transfer surface upon which the device is in use stood;

said device comprising a heat insulated body having an opening at one end and an interior cavity to which said opening provides communication, said one end of said body defining a generally annular base surface around said opening for engaging said heat transfer surface when the device is stood thereon, said cavity extending away from said base surface and having therein a member which extends at least partly across the cavity to substantially close off a portion of the cavity between the member and an opposite end of said body remote from said one end, said member presenting an inwardly directed support surface for supporting solid carbon dioxide thereon within said closed off portion of the cavity, and adjustment means being provided for moving said member to vary the spacing between the support surface of the member and said base surface whereby, when the device is in use stood on said heat transfer surface, the resistance to heat flow from the heat transfer surface to solid carbon dioxide supported on the support surface is variable by varying said spacing.

2. Device as claimed in claim 1 wherein said body has a transverse wall at said opposite end and a depending peripheral skirt portion of generally annular transverse section, the interior surface of the skirt portion defining a side of said cavity and an inner surface of said transverse wall defining an inner end of said cavity, said skirt portion defining said opening at the end thereof opposite said transverse wall and said base surface being provided by an end surface of the skirt portion surrounding said opening, said interior surface of said skirt portion being non-circular in transverse section, said member being in the form of a plate extending across the cavity in generally parallel disposition to said transverse wall and of peripheral configuration generally complementary to the cross-sectional configuration of said interior surface whereby the plate is movable in said cavity in the direction of extent thereof from said opening to said transverse wall but is prevented from rotation in its plane, said adjustment means including an axially rotatable elongate element passing through said transverse wall from the exterior of said body into said cavity, said axially rotatable element extending in the direction of said movement, the axially rotatable element and said plate carrying cooperating threaded elements such that, when the rotatable element is rotated, the threaded element carried by the plate is moved along the length of the rotatable element to effect said varying of said spacing.

3. A device as claimed in claim 2 wherein said elongate member is provided, at a location exterior to the body, with a hand wheel for manual rotation thereof.

4. Device as claimed in claim 1 wherein said member is formed from plastics material.

5. A device as claimed in claim 1 wherein said body is formed of plastics material, having outer skins of relatively dense plastics material and an interior portion therebetween of relatively less dense heat insulating plastics material.

6. A heat insulated container for articles to be stored at a temperature different to ambient, said container having therein a device for storing solid carbon dioxide for cooling such articles, said device being supported on an internal surface of the container such that it is freely movable in the container and removable therefrom; said container comprising a base and an upstanding peripheral wall portion extending therefrom, said base and said upstanding wall portion being heat insulating, a base plate of high thermal conductivity being positioned within the container and over said base so that an upper heat transfer surface thereof defines said internal surface, said device comprising a heat insulated body with an interior cavity open to a lower base surface resting on said heat transfer surface, said device including means for supporting a quantity of said carbon dioxide in said cavity.

7. A container as claimed in claim 6 wherein said means for supporting comprises a member positioned within the cavity.

8. A container as claimed in claim 7 wherein said device includes means for variably positioning said member to vary the spacing of the member from said heat transfer surface to thereby regulate the cooling effect to frozen carbon dioxide when positioned in said device.

9. A container as claimed in claim 6 wherein said base plate is supported on relatively small size protuberences extending from the upper surface of said base.

10. A heat insulated container for articles to be stored at a temperature different to ambient, said container having therein a device for storing solid carbon dioxide for cooling such articles, said device being supported on an internal surface of the container such that it is freely movable in the container and removable therefrom; said container comprising a base and an upstanding peripheral wall portion extending therefrom, said base and said upstanding wall portion being heat insulating, a base plate of high thermal conductivity being positioned within the container and over said base so that an upper heat transfer surface thereof defines said internal surface, said device comprising a heat insulated body having an opening at one end and an interior cavity to which said opening provides communication, said one end of said body defining a generally annular base surface around said opening engaging said heat transfer surface, said cavity extending away from said base surface and having therein a member which extends at least partly across the cavity to substantially close off a portion of the cavity between the member and an opposite end of said body remote from said one end, said member presenting an inwardly directed support surface for supporting solid carbon dioxide thereon within said closed off portion of the cavity, adjustment means being provided for moving said member to vary the spacing between the support surface of the member and said heat transfer surface whereby the resistance to heat flow from the heat transfer surface to solid carbon dioxide supported on the support surface is variable by varying said spacing.

11. A container as claimed in claim 10 wherein said body has a transverse wall at said opposite end and a depending peripheral skirt portion of generally annular transverse section, the interior surface of the skirt portion defining a side of said cavity and an inner surface of said transverse wall defining an inner end of said cavity, said skirt portion defining said opening at the end thereof opposite said transverse wall and said base surface being provided by an end surface of the skirt portion surrounding said opening, said interior surface of said skirt portion being non-circular in transverse section, said member being in the form of a plate extending across the cavity in generally parallel disposition to said transverse wall and of peripheral configuration generally complementary to the cross-sectional configuration of said interior surface whereby the plate is movable in said cavity in the direction of extent thereof from said opening to said transverse wall but is prevented from rotation in its plane, said adjustment means including an axially rotatable elongate element passing through said transverse wall from the exterior of said body into said cavity, said axially rotatable element extending in the direction of said movement, the axially rotatable element and said plate carrying cooperating threaded elements such that, when the rotatable element is rotated, the threaded element carried by the plate is moved along the length of the rotatable element to effect said varying of said spacing.

12. A container as claimed in claim 10 wherein said member is formed from plastics material.

13. A heat insulated container for articles to be stored at a temperature different to ambient, said container having therein a device for storing solid carbon dioxide for cooling such articles, said device being supported on an internal surface within the container such that it is freely movable in the container and removable therefrom; said container comprising, structure defining a base and an upstanding peripheral wall portion extending therefrom to an access aperture to the container interior, together with a lid and securement means for securing said lid to said structure, said lid being conditionable in a first condition allowing access to the container interior via said aperture and to a second condition at which it is secured by said securement means to said structure so that the lid closes said aperture and presents to the container interior an inner surface which is substantially parallel to but spaced from said internal surface, said device being of height substantially equal to the spacing then existing between the inner and internal surfaces such that it is engaged at opposed ends by respective ones of these surfaces and clamped in position therebetween when the lid is in said second condition.

14. A container as claimed in claim 13 wherein a resilient element is secured to one of said lid and device to be interposed in compressed condition between the lid and device when the lid is in said second condition.

15. A container as claimed in claim 14 wherein a base plate of high thermal conductivity is positioned within the container and over said base so that an upper heat transfer surface thereof defines said internal surface, said device comprising a heat insulated body with an interior cavity open to a lower end surface resting on said heat transfer surface, said device including means for supporting a quantity of solid carbon dioxide in said cavity.

16. A container as claimed in claim 15 wherein said means for supporting comprises a member positioned within the cavity.

17. A container as claimed in claim 16 wherein said device includes means for variably positioning said member to vary the spacing of the member from said heat transfer surface to thereby regulate the cooling effect of frozen carbon dioxide when positioned in said device.

18. A container as claimed in claim 13 wherein a base plate of high thermal conductivity is positioned within said container and over said base so that an upper heat transfer surface thereof defines said internal surface, said device comprising a heat insulated body having an opening at one end and an interior cavity to which said opening provides communication, said one end of said body defining a generally annular base surface around said opening engaging said heat transfer surface, said cavity extending away from said base surface and having therein a member which extends at least partly across the cavity to substantially close off a portion of the cavity between the member and an opposite end of said body remote from said one end, said member presenting an inwardly directed support surface for supporting solid carbon dioxide thereon within said closed off portion of the cavity, and adjustment means being provided for moving said member to vary the spacing between the support surface of the member and said base surface whereby the resistance to heat flow from the heat transfer surface to solid carbon dioxide supported on the support surface is variable by varying said spacing.

19. A container as claimed in claim 18 wherein said body has a transverse wall at said opposite end and a depending peripheral skirt portion of generally annular transverse section, the interior surface of the skirt portion defining a side of said cavity and an inner surface of said transverse wall defining an inner end of said cavity, said skirt portion defining said opening at the end thereof opposite said transverse wall and said base surface being provided by an end surface of the skirt portion surrounding said opening, said interior surface of said skirt portion being non-circular in transverse section, said member being in the form of a plate extending across the cavity in generally parallel disposition to said transverse wall and of peripheral configuration generally complementary to the cross-sectional configuration of said interior surface whereby the plate is movable in said cavity in the direction of extent thereof from said opening to said transverse wall but is prevented from rotation in its plane, said adjustment means including an axially rotatable elongate element passing through said transverse wall from the exterior of said body into said cavity, said axially rotatable element extending in the direction of said movement, the axially rotatable element and said plate carrying cooperating threaded elements such that, when the rotatable element is rotated, the threaded element carried by the plate is moved along the length of the rotatable element to effect said varying of said spacing.

20. A container as claimed in claim 19 wherein said member is in the form of a plate of plastics material.

21. A container as claimed in claim 6 wherein said base plate is supported in spaced relationship over the upper surface of said base.

* * * * *